US007234178B2

(12) United States Patent
Qi

(10) Patent No.: US 7,234,178 B2
(45) Date of Patent: Jun. 26, 2007

(54) ELECTROMOTIVE BED

(76) Inventor: Daoyi Qi, B-L-19, Guishan City Garden, 38 Shengfubei Road, Guiyan City, Guizhou Province, 550001 (CN)

( * ) Notice: Subject to any disclaimer, the term of this patent is extended or adjusted under 35 U.S.C. 154(b) by 0 days.

(21) Appl. No.: 10/892,123

(22) Filed: Jul. 16, 2004

(65) Prior Publication Data

US 2005/0015877 A1 Jan. 27, 2005

(30) Foreign Application Priority Data

Jul. 18, 2003 (CN) ..... 03 1 35445
Jul. 18, 2003 (CN) ..... 03 2 49581
Jul. 18, 2003 (CN) ..... 03 2 49582

(51) Int. Cl.
*A61G 7/02* (2006.01)
*A61G 7/015* (2006.01)

(52) U.S. Cl. ..... 5/604; 5/605; 5/618; 5/621

(58) Field of Classification Search ..... 5/604, 5/605, 613, 610, 618, 621
See application file for complete search history.

(56) References Cited

U.S. PATENT DOCUMENTS 3,462,777 A * 8/1969 Lutsky ..... 5/722
5,500,964 A * 3/1996 Bergersen ..... 5/607
5,640,729 A * 6/1997 Marino ..... 5/607
5,699,566 A * 12/1997 Chuang ..... 5/613
6,934,987 B2 * 8/2005 Newkirk et al. ..... 5/613

* cited by examiner

*Primary Examiner*—Alexander Grosz
(74) *Attorney, Agent, or Firm*—Baker & Hostetler LLP

(57) ABSTRACT

An electromotive bed, having a bed body, the bed including a mattress having a pair of rectangular through holes extending therethrough in middle upper portion of the mattress and disposed in the direction of the width of the mattress; a respective supporting block mounted rotatably to move between a position in which the block protrudes upward through each respective through hole and a position in which the block does not protrude through the through hole, the block comprising at least two pin receiving holes therein, and a shaft pin insertable in the holes to provide a pivot mounting about which block rotates, the block also having a slit extending into the block; and a deflector arm having a deflector rod that contacts the slit, wherein the deflector arm is adapted to be driven by a load transfer device in order to pivot the block between the first and second positions; wherein the mattress also comprises an additional hole, and wherein the bed also includes a defecation device below the additional hole, the defecation device comprising; a filling pad disposed to block the additional hole, having a sleeve on its bottom surface; a spacer sleeve provided between the filling pad and the edge of the additional hole; a spring attached to the spacer sleeve; a sealed cowling; a bedpan connected hermetically to the sealed cowling; and a mechanical linkage connected to the filling pad via the spacer sleeve and adapted to be power driven.

12 Claims, 9 Drawing Sheets

ELECTROMOTIVE BED

FIELD OF THE INVENTION

This invention relates to a health care electromotive bed, especially to an electromotive bed that can turn the patient over and has a bedpan.

BACKGROUND OF THE INVENTION

Generally speaking, the elderly, the disabled and patients who are confined to their electromotive beds for a long time and who have difficulty moving freely face the problem of turning over and defecation while confined to the electromotive bed. These problems need to be solved so that they can turn over for ventilation to avoid bedsores, and so they can relieve themselves on the electromotive bed conveniently, comfortably and hygienically.

Of the current techniques, there is a kind of electromotive bed having a net sling. A device which may be used to lift the net sling up as required is fixed on the electromotive bed, so that the human body is lifted at the same time. Therefore, this technique accomplishes ventilation through the open nature of the net sling and prevents the person confined to the electromotive bed from suffering ailments such as bedsores, etc. However, such products are complicated in structure and inconvenient for use, and cannot provide users with natural and comfortable operation. Many other electromotive beds capable of turning over the person confined are also published such as in the China patent gazette, but these electromotive beds usually divide the electromotive baseplate into two parts, of which, one part is immobilized and another part can be turned over to make human body turn around. But such a means of turning the user over still keeps the whole back of the human body closely fitting on the electromotive mattress, and can not provide ventilation. Therefore, it is still difficult to avoid the bedsores caused by a long confinement to bed, bad ventilation and disinfection, and high humidity.

There are many existing electromotive beds with bedpans, but most of them are without automatic jets so that the person lying on the electromotive bed cannot clean himself. Some products do have spray systems but in some cases the water stream may be sprayed on the electromotive bed, clothing, and sometimes on other parts during operation, thereby resulting in inconveniences to the users. The person using the electromotive bed still may not have the ability to defecate without the help of another person, because a removeable cushion at the relieving position on the electromotive bed can be removed only with the cooperation of other people.

Although, each kind of existing electromotive bed has various functions, still the above problems can not be solved completely. Also, these products are complicated in structure and expensive in price, therefore they are not readily accepted by the common consumer.

SUMMARY OF THE INVENTION

The invention is aimed at providing a kind of electromotive bed that can turn the human body over and has a bedpan, which enables the user of the electromotive bed to turn over and to defecate. Also, in some embodiments, cleaning, drying and ventilation can be carried out and thus the user who is confined to the electromotive bed for a long time is inhibited from developing bedsores.

The advantages of this invention are that the electromotive bed which can turn the human body over and has a bedpan not only enable the user confined to the electromotive bed to use without assistance supporting blocks which enable the user to turn over freely while lying on the electromotive bed and with a defecation device which enables users to relieve themselves by themselves lying on the electromotive bed, but also provides cleaning, drying and ventilating measures so that the person confined to bed for a long time does not suffer from bedsores, and also enable the patients relieve themselves comfortably while on the electromotive bed in a sitting position so as to prevent waste from overflowing. Therefore, the use of the electromotive bed according to the invention that can turn the human body over and has a bedpan, can relieve nursing personnel of the burden of providing a full-time nurse and care, and improve considerably the nursing condition for the patients who are unconscious and have lost or are losing all of their mobility.

In addition, this invention is simple in structure, convenient to use and easy to clean, and has a low price and are therefore suitable for a common family. Furthermore, the products operate gently, are convenient to use and are without any hazard.

DETAILED DESCRIPTION OF THE PREFERRED EMBODIMENTS

Example 1

Figure 1:
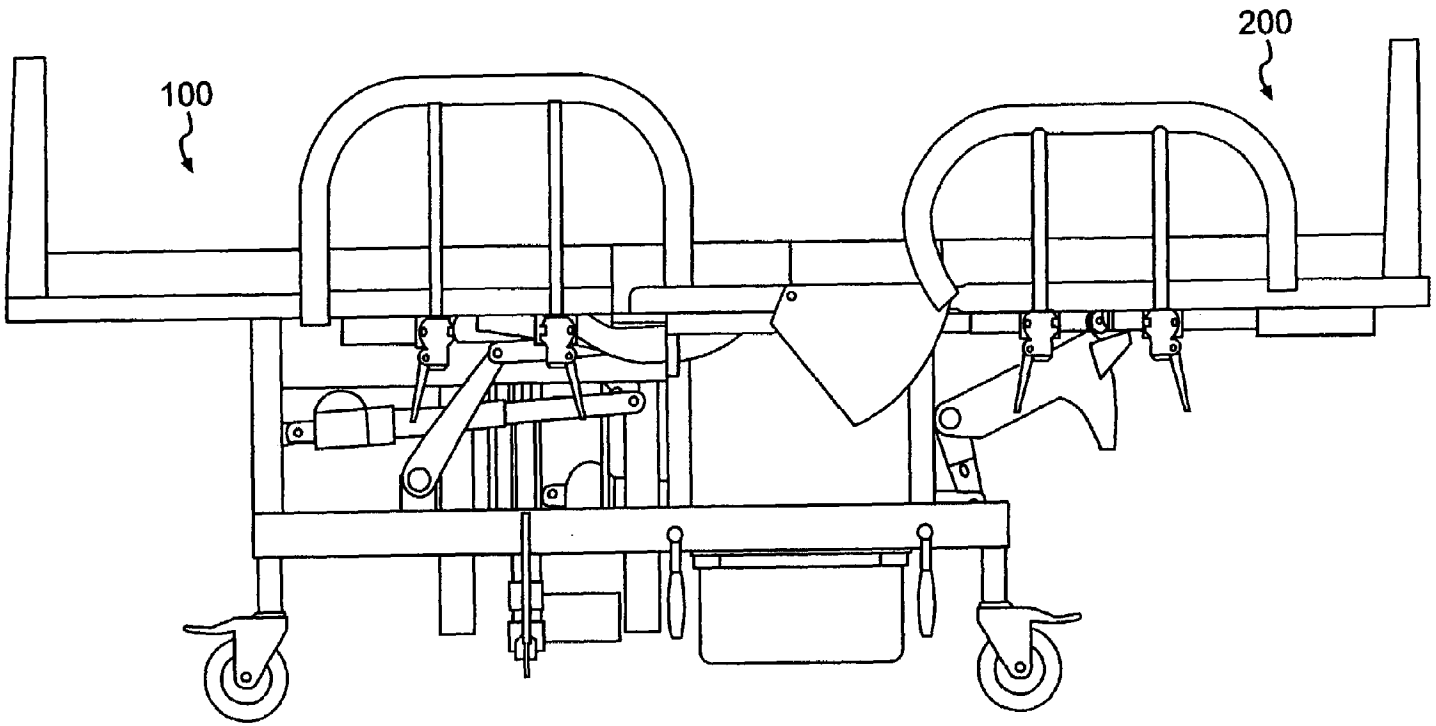
FIG. 1 is an integral structural representation of the electromotive bed capable of turning over a patient and having a bedpan.
Figure 2:
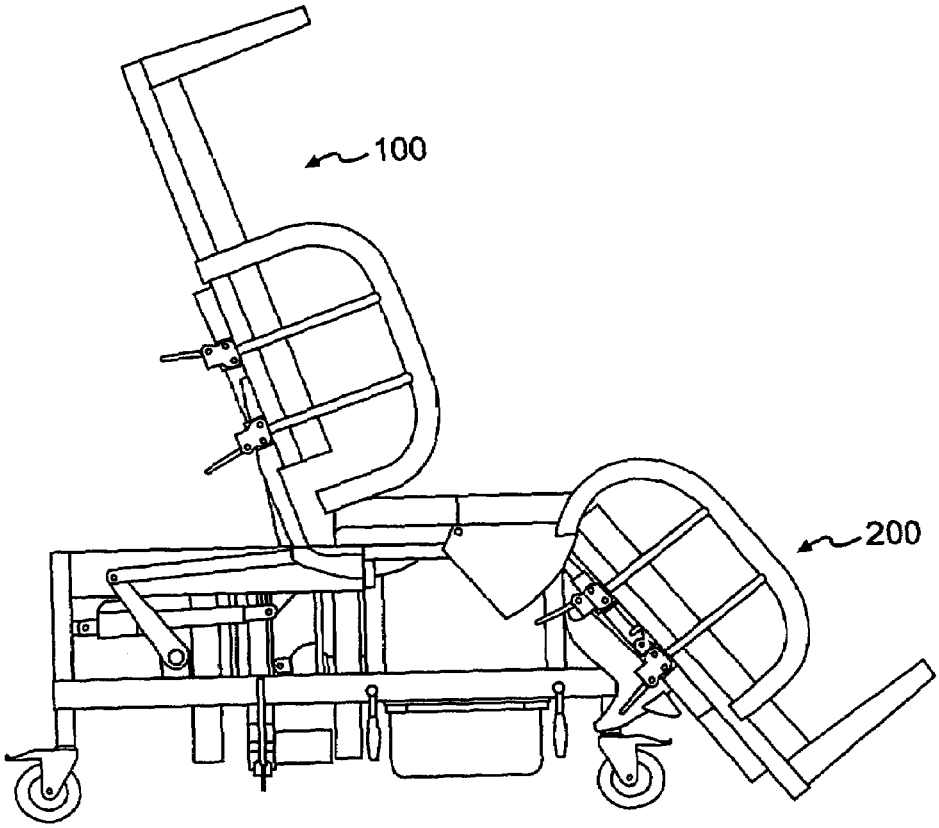
FIG. 2 is a structural representation of the electromotive bed invention which is adjusted into a sitting position.

As shown in FIGS. 1 and 2, the electromotive bed of the example includes a back raising device 100 and a leg lowering device 200, to enable the patient to relieve himself comfortably on the electromotive bed while in a sitting position.

Figure 3:
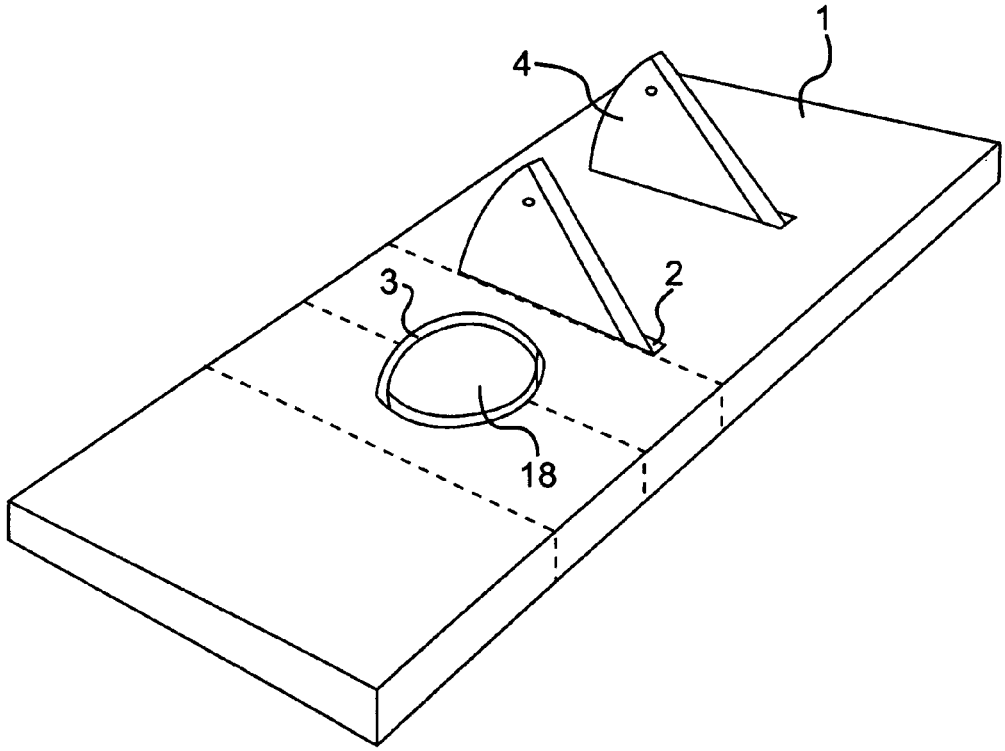
FIG. 3 is an integral structural representation of a mattress of the electromotive bed according to the invention.

As shown in FIG. 3, two rectangular through holes 2 are opened in the middle upper portion of the mattress 1 along its width line, and a hole 3 for defecation is opened at an appropriate position in the middle lower portion of the mattress. A supporting block 4 is installed in each through hole 2 to aid in turning the patient over, and the lateral axis of the supporting block 4 is perpendicular to the axial line of the electromotive bed.

Figure 4:
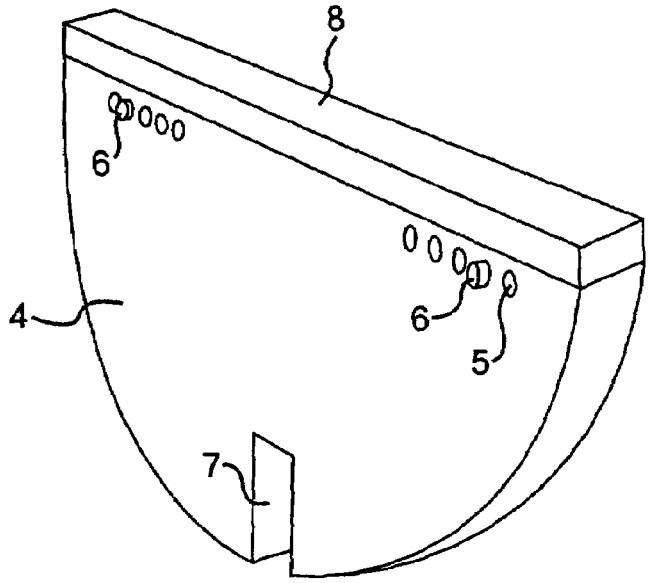
FIG. 4 is a structural representation of a supporting block in the electromotive bed according to the invention.

As shown in FIG. 4, five shaft pin holes 5 are formed symmetrically on both left and right sides of the upper end of peach-shape supporting block 4, and shaft pins 6 are installed in the second shaft pin holes 5 from outside respectively. Additionally, a slit 7 is opened at the nose bit of the supporting block along the center line.

Figure 5:
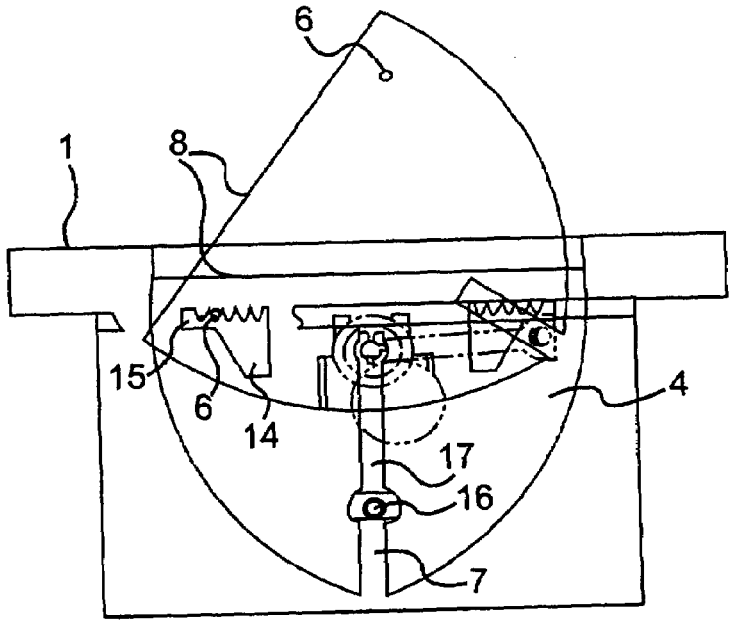
FIG. 5 is a view of the supporting block in the electromotive bed according to the invention.

As shown in FIG. 5, a shaft pin supporting plate 14 is fixed to each end of the two opposing longer side edges of the inner wall of through hole 2 respectively, and each shaft pin 6 protrudes from the surface of supporting block 4 with its two ends locked correspondingly in gullets 15 of the two shaft pin supporting plates 14 fixed on the electromotive bed body. In this way, the supporting block 4 can be fixed rotatablely to the electromotive bed through shaft pins 6. In this example, the supporting blocks 4 have a width of 8 cm and its contact surface 8 is lower than the mattress surface to ensure proper ventilation of the patient's back and comfortable use.

A deflector rod 16 is inserted into the slit of the supporting block 4, and one end of the deflector rod 16 fixes vertically to an end of a deflector arm 17. Meanwhile, another end of the deflector arm 17 connects to a load transfer device with which the supporting block 4 can be overturned to the left around the shaft pin 6 at the left side or overturned to right around the shaft pin 6 at the right side.

The peach shaped supporting block 4 can prevent the clothing of the patient lying on the electromotive bed from being caught or his skin being injured during service. Starting up the load transfer device to drive the deflector arm to rotate, and through the deflector arm, the deflector rod moves to drive the supporting block 4 to turn around the shaft pin 6 fixed in the shaft pin hole 5. Therefore, the patient lying on the electromotive bed can turn over. In addition, a smooth surface of the supporting block 4 is provided.

Figure 6:
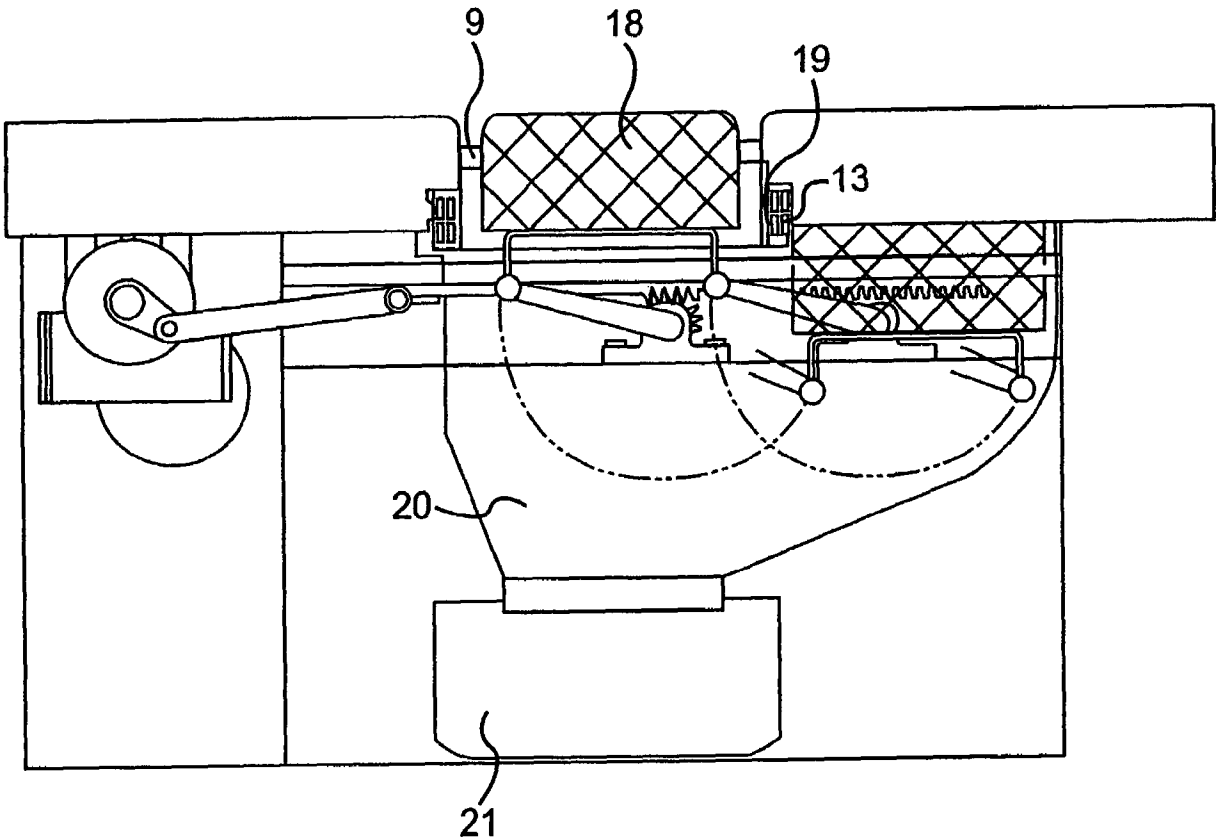
FIG. 6 is a view of a filling pad in the electromotive bed according to the invention.

As shown in FIG. 6, a filling pad 18 is placed in the hole 3 at the middle portion of the mattress and a spacer sleeve 9 is placed between the filling pad 18 and the hole 3. A sealed cowling 20 is installed under the hole 3, and a bedpan 21 is connected to the sealed cowling 20. The filling pad 18 connects to a mechanical linkage device through the sleeves fixed parallelly at both sides of the bottom, and a part of the mechanical linkage device is located within the sealed cowling 20. The front and rear spray pipes can also be fixed as required within the sealed cowling 20.

In this example, the supporting block 4, spacer sleeve 9, sealed cowling 20 and bedpan 21 are all made of plastic. The plurality of shaft pin holes 5 formed on the supporting block 4 are designed to be adjusted in reference to the width of the patient's body. The supporting block 4 is placed on the electromotive bed after the shaft pins 6 are installed in the shaft pin holes only if the supporting block 4 can be overturned normally. The load transfer device may be manufactured according to related art. The width of the supporting block 4 may be selected in a range of 4–12 cm. A spray pipe 26 is connected to a tap water pipe through a solenoid electric valve, or to a tank watering manually through a water pump.

The load transfer device for controlling the electromotive bed's function to aid a patient in turning over can employ the existing mechanical transmission device or hydraulic transmission device, electric transmission mechanism, etc., and the commonly used gear transmission, worm gear transmission, worm screw transmission, etc., devices in the related art can be adopted.

The side of the supporting block 4 at the middle part of the electromotive bed is perpendicular to the axial line of the electromotive bed. Such an angle can ensure comfort during service. But the angle need not be 90 degrees all of the time. The contact surface 8 of the supporting block 4 should be lower than the surface of electromotive mattress. Such a structure can ensure the air passing over the surface of the turnover supporting block 4 during regular use of the electromotive bed to provide as much ventilation as possible. Since the product has only 2–3 supporting blocks 4, it can guarantee the patient is turned over and sufficient ventilation of most parts of his back. More than two shaft pin holes 5 is used in the product, which can guarantee the product being able to overturn to either left or right to meet the requirements of the user.

The filling pad 18 connects to the mechanical linkage device according to the existing mechanical connection principle. In the configuration of the product, the existing measure can be used to guarantee the filling pad 18 being either at a position to fill the hole 3 or a position beside one side of hole 3 under the electromotive mattress. The filling pad 18 is placed to fill hole 3 under normal conditions. Since its thickness equal to that of the electromotive mattress, the filling pad 18 should not affect the normal use. Start up of the power installation is required for defecation. A cross rod 32 and a drive sleeve 31 move under the action of a mechanical linkage device, thereby moving the filling pad 18 under the electromotive bed to provide access to the bedpan.

The front and rear inner walls of the sealed cowling 20 are installed with electrically controlled spray pipes 26. Power to the spray pipes 26 can be turned on to perform cleaning and then drying with warm air device while in use. During cleaning the inner wall of the sealed cowling 20 is also washed while water is sprayed to the relevant part of the human body.

To prevent the electromotive mattress from becoming wet during use of the spray pipes 26, this product is mounted additionally with a spacer sleeve 9. Since the top surface of the spacer sleeve 9 is lower than the surrounding mattress 1 and the filling pad 18 under normal conditions, the patient is unlikely to come into contact with it. If the filling pad 18 is moved away for defecation, the patient's body should compress the surrounding mattress 1 and come into contact with the moveable spacer sleeve 9. The moveable spacer sleeve 9 can displace a certain distance downward supported by the elastic force of the spring 19.

Example 2

This example further provides a preferable scheme for the part of the electromotive bed invention that provides for the patient to be turned over.

Figure 7:
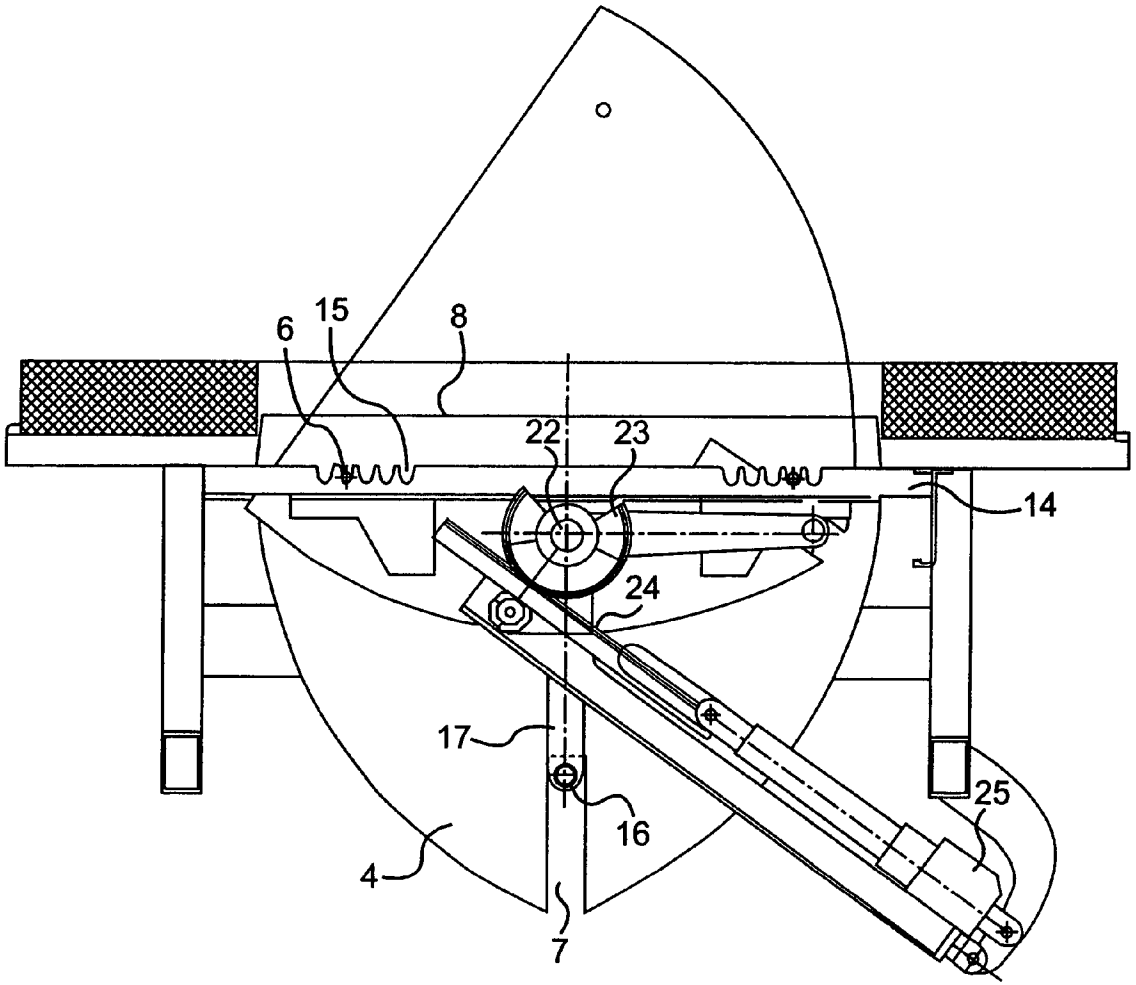
FIG. 7 is a view of one example of the supporting block in the electromotive bed according to the invention.

As shown in FIG. 7, two crossbar shaft pin supporting plates 14 are installed correspondingly on the longer sidewalls of the through hole 2, and the gullet is formed at the upside of the supporting plate 14. Both ends of two shaft pins 6 are set symmetrically, protrude from the surface of the supporting block 4, and are locked respectively in the gullets 15 on one end of the two shaft pin supporting plates 14. The supporting block 4 is clamped by two crossbar shaft pin supporting plates 14 and is installed stably and rotatablely on the electromotive bed through the shaft pin 6. The width of the supporting block 4 in this example is 6 cm.

The load transfer device in this example includes a rotating shaft 22 fixed on the electromotive bed. A deflector arm 17 and a first gear 23 are mounted around the rotating shaft 22, and the end of the deflector arm 17 connects to a deflector rod 16 inserted into a slit 7. The first gear 23 engages with a first rack rod 24, and one end of the first rack rod 24 connects to a first unit head 25 which can move back and forth in a straight line.

The first unit head 25 drives the first rack rod 24 to move back and forth in a straight line. The first rack rod 24 rotates the first gear 23 engaged with it backward and forward, and the rotating shaft 22 fixed on the first gear 23 drives the deflector arm 17 to waggle. In this way, the deflector arm 17 drives the supporting block 4 through the deflector rod 16 at one end of the deflector arm 17, and the supporting block 4 waggle with the left and right shaft pins 6 as the fulcrum that the contact surface 8 at the top surface of supporting block 4 lift up the human body to turn it over.

The contact surface 8 is made of a soft material, and symmetrical shaft pin holes 5 are formed on the supporting block 4. If the shaft pins 6 are inserted into different symmetric shaft pin holes 5, the protruded length of the top surface of turnover supporting block 4 from the electromotive bed surface can be adjusted to adapt to patients having different body widths.

The other parts are same as in example 1.

Example 3

This example further provides a preferable scheme for the defecation device of the electromotive bed according to the invention.

Figure 8:
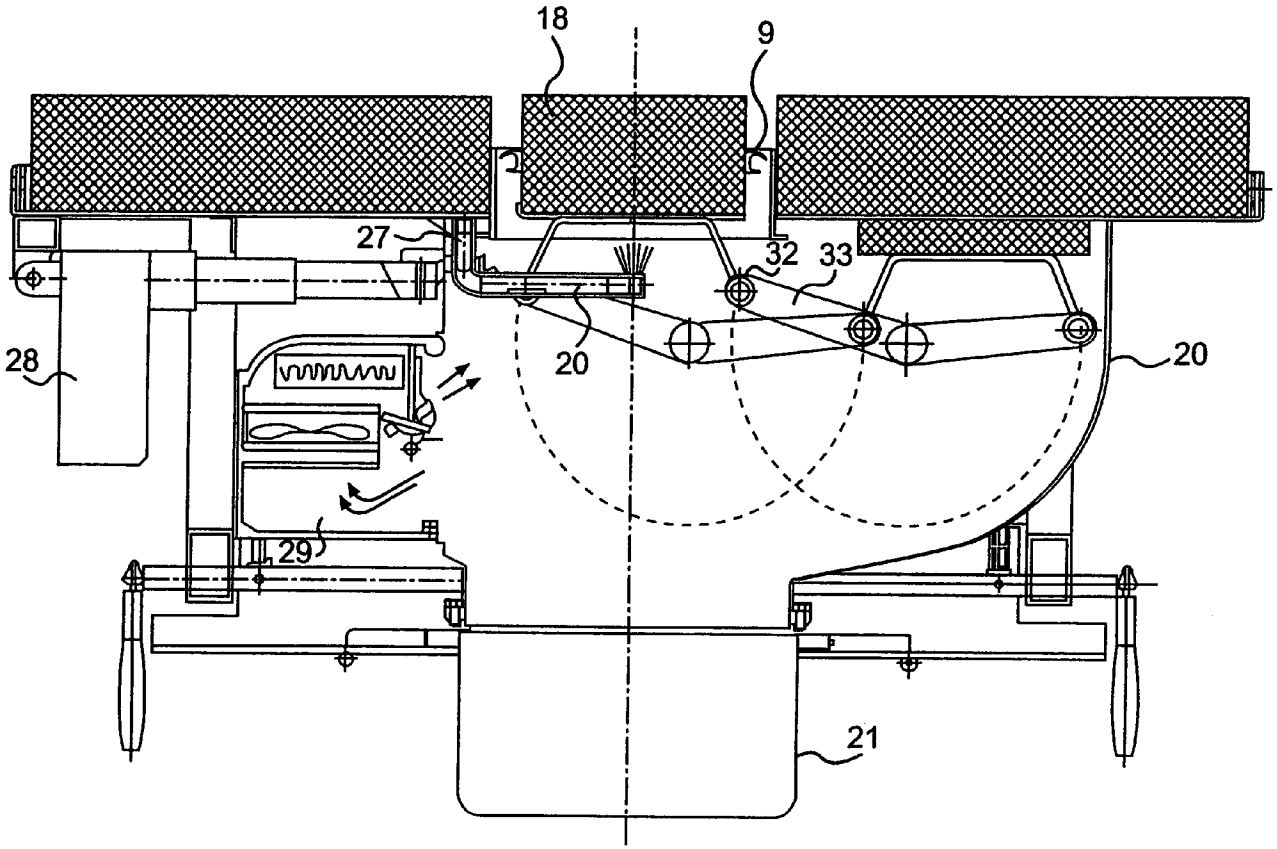
FIG. 8 is a view of one example of the filling pad in the electromotive bed according to the invention.

As shown in FIG. 8, the filling pads 18 connect rotatably with a cross rod 32 through four sleeves 31 (each two as a group). The cross rod 32 is integrated with a crank 33, minor axis 34, and second gear 35 into one block and can rotate around a bearing block 37.

Figure 9:
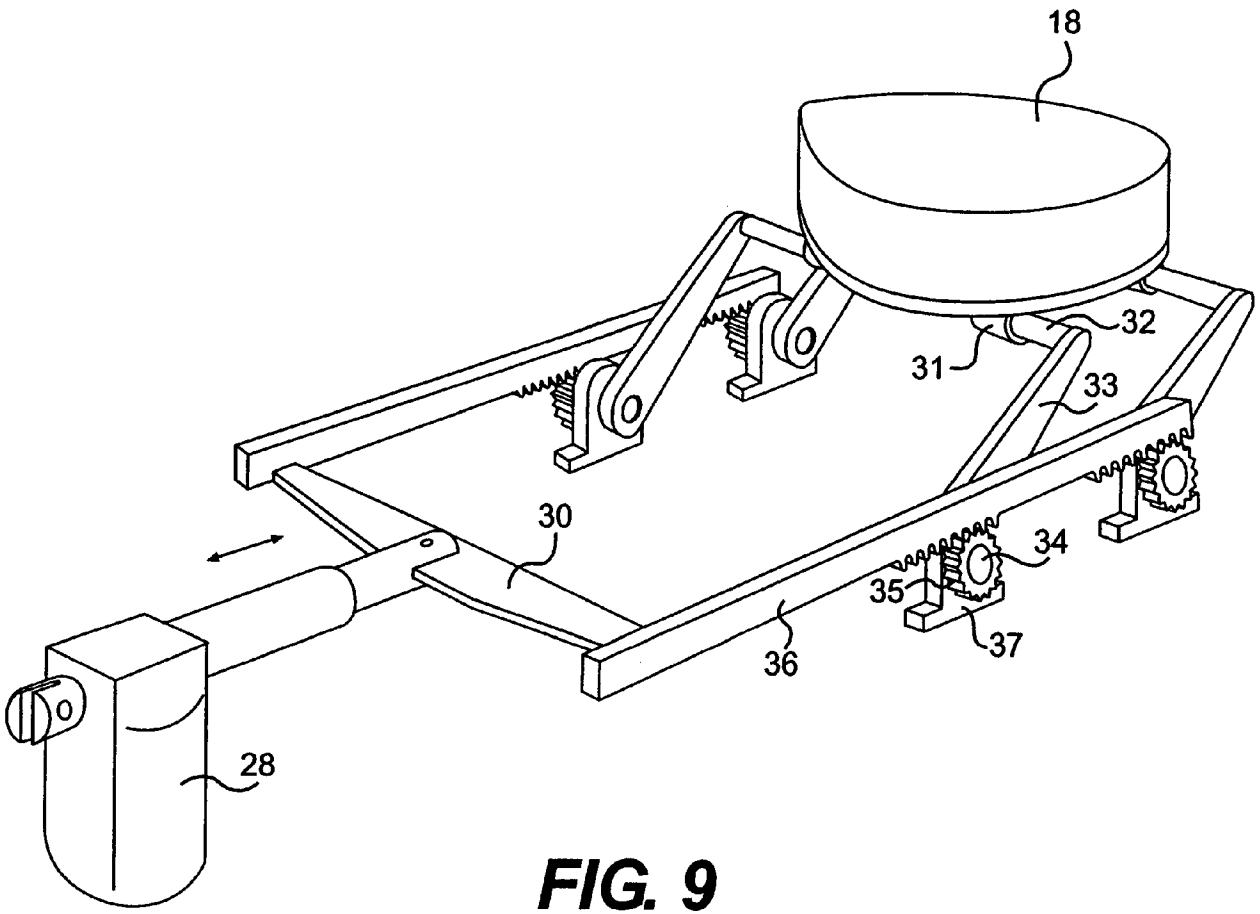
FIG. 9 is a structural representation of one example of a mechanical linkage device in the electromotive bed according to the invention.

As shown in FIG. 9, a second rack rod 36 engages with the second gear 35, and further connects to a second unit head 28 through the bearing rod 30. The second unit head 28 drives the second rack rod 36 to move back and forth in a straight line, and makes the second gear 35 to rotate back and forth and drive the crank 33 through the minor axis 34 fixed to the second gear 35, and further drive the cross rod 32 to waggle. In this way, the sleeves 31, formed parallelly at both sides of the bottom surface of filling pad 18, waggle together with the cross rod 32 along an arc track. The plane determined by the axial lines of the two cross rods 32 is always parallel with the electromotive bed surface during motion because the two cross rods 32 are always parallel with each other. Therefore, the filling pad 18 keeps its top surface upward during motion, and the filling pad 18 can fill up and level up the hole 3 of the electromotive mattress when it moves to a stop point. The filling pad 18 can also withstand the baseplate of the electromotive bed surface and be compressed so as to hide under the baseplate at one side to avoid being contaminated if it moves to another stop point. Moreover, the filling pad 18 moves in a subvertical direction if the area of electromotive bed surface is closed, which shall not exercise a detrimental effect.

The other parts are same as in example 1.

Example 4

This example further provides a preferable scheme for the cleaning device of the electromotive bed according to the invention.

Figure 10:
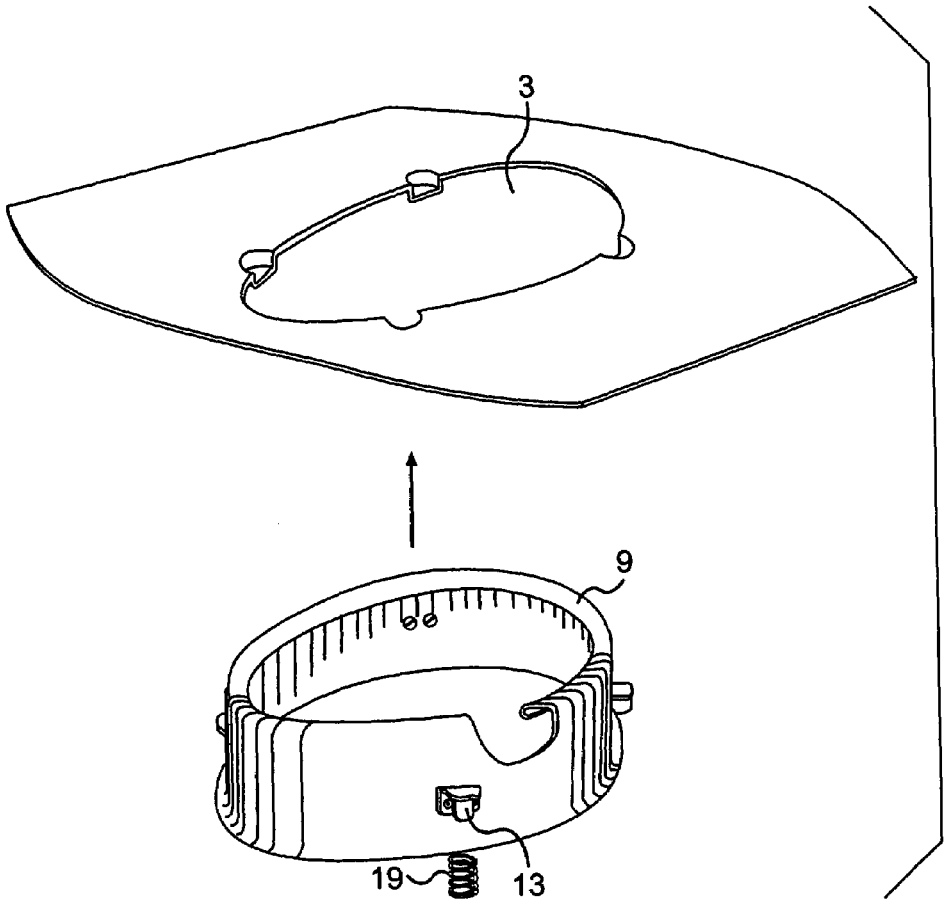
FIG. 10 is a structural representation of one example of a spacer sleeve at an opening of the electromotive bed according to the invention.

As shown in FIG. 10, a hole 3 is opened at the middle section of the mattress 1, and a spacer sleeve 9 which can move up and down in the hole 3 connects elastically to the baseplate of electromotive bed surface through the fixed parts 13 and springs 19. The human body shall shift downward owing to the bearing surface area reducing when the filling pad 18 is moved, and the circumference of the rump contact the spacer sleeve 9 and compress the spring 19. With respect to different body weights, spring 19 may automatically regulate the distribution of supporting force to the patient's body by the spacer sleeve 9 and the elastic mattress 1 around to increase comfort.

The spacer sleeve 9 can act as a sealing device to prevent the electromotive mattress from being contaminated during defecation and flushing. The top surface of the spacer sleeve 9 shall be lower than the electromotive bed surface and not contact human body while the filling pad 18 is in the hole 3. The sealed cowling 20 closely fitting to the baseplate of electromotive bed surface is under the spacer sleeve 9, and the lower opening of the sealed cowling 20 is connected moveably and tightly to the closestool 21.

The minor axis 34 of the motion device of the filling pad 18 passes through the sealed cowling 20 and the bearing block 37 respectively with its inner end connecting to the crank 33 and outer end to the second gear 35, and can rotate around the bearing block 37. In this way, the filling pad 18, the cranks, and cross rods of the mechanical linkage device shall be within the sealed cowling.

In this example, a water nozzle 26 which can rotate around a shaft 27 is installed at one side of the hole 3 opened on the baseplate of the electromotive bed surface within the sealed cowling 20. The water nozzle 26 shall be rotated to aim at the location to be flushed and start spraying while in operation, and the water nozzle 26 can wiggle in a small range to flush different location during spraying. The water nozzle 26 shall be rotated for 90 degrees and hidden at the side of hole 3 to avoid being contaminated after operation.

The sealed cowling 20 is opened with a window connected to a warm air assembly 29, which includes: a photocatalyst filter screen, an electric fan, a heating cord and a moveable throttle. The fan can be turned on to height and the heating cord can be powered on while performing drying after flushing. Air enters into the warm air assembly 29 from the sealed cowling 20, and passes through the filter screen, the electric fan and the heating cord, blow open the moveable throttle and finally blow to the rump of the human body. The heating cord cannot be powered on and the fan can be turned on to low, while drying is not required. Wind can not blow open the moveable throttle and the air only flows out from the circumference gap to perform the circulating deodorization and sterilization.

The bottom of the defecation device in this invention can be configured to connect to a sewer, and a water source for flushing may be connected to a tap water pipe or a manually filled water-storage tank. Additionally, the flushing water has to be warmed to a moderate temperature by a temperature adjustable heater, and the temperature of air for drying should also be adjustable.

The other parts are same as in example 1.

The invention claimed is:

1. An electromotive bed, having a bed body, the bed comprising:

a mattress having a pair of rectangular through holes extending therethrough in middle upper portion of the mattress and disposed in the direction of the width of the mattress;

a respective supporting block mounted rotatably to move between a position in which the block protrudes upward through each respective through hole and a position in which the block does not protrude through the through hole, the supporting block comprising at least two pin receiving holes therein, and a shaft pin insertable in the holes to provide a pivot mounting about which block rotates, the block also having a slit extending into the block; and a deflector arm having a deflector rod that contacts the slit, wherein the deflector arm is adapted to be driven by a load transfer device in order to pivot the block between the first and second positions;

wherein the mattress also comprises an additional hole, and wherein the bed comprises a defecation device below the additional hole, the defecation device comprising;

a filling pad disposed to block the additional hole, having a sleeve on its bottom surface;

a spacer sleeve provided between the filling pad and the edge of the additional hole;

a spring attached to the spacer sleeve;

a sealed cowling;

a closestool connected hermetically to the sealed cowling; and a mechanical linkage connected to the filling pad via the spacer sleeve and adapted to be power driven.

2. The electromotive bed of claim 1, wherein the turnover supporting block is in the shape of a peach and has a thickness of 4–12 cm.

3. The electromotive bed of claim 1, wherein the turnover supporting lock has an upper end face providing a contact surface, and wherein when the block is in the second position the end face provides a contact surface which is beneath the top surface of the mattress.

4. The electromotive bed of claim 1, comprising an idler wheel in between the deflector rod and the slit.

5. The electromotive bed of claim 1, further comprising four shaft pin supporting plates located at the longer sides of the through hole, with each supporting plate having at least one notch, and wherein the shaft pin extends from both sides of the supporting block when installed in a respective hole, and extended ends of the pin lock into any of the notches of the shaft pin supporting plate.

6. The electromotive bed of claim 1, further comprising four shaft pin supporting plates in the shape of a crossbar located at the longer sides of the through hole, with each supporting plate having at least one notch, and wherein the shaft pin extends from both sides of the supporting block when installed in a respective hole, and extended ends of the pin lock into any of the notches of the shaft pin supporting plate.

7. The electromotive bed of claim 1, wherein the load transfer device comprises a rotating shaft fixed on the electromotive bed, and wherein the deflector arm and a first gear are mounted coaxially on the rotating shaft so that an end of the deflector arm connects to the deflector rod which is inserted into the slit, and wherein the first gear engages with a first rack rod having one end, and the end of the first rack rod connecting to a first unit head which is mounted for reciprocal movement.

8. The electromotive bed of claim 1, further comprising a water nozzle installed to the side of the additional hole.

9. The electromotive bed of claim 1, further comprising a window on the sealed cowling and a warm air assembly connected to the window having a photocatalyst filter screen, an electric fan, a heating cord, and a movable throttle.

10. The electromotive bed of claim 1, wherein the mechanical linkage includes two cross rods; two parallel sleeves located below the filling pad; a crank located on each end of the two cross rods; four bearing blocks to support the crank; four second gears on the cranks; and two second rack rods engaging with the four second gears, each rack rod engaging with two of the gears on the same side of the cross rod, with the two second rack rods being mounted symmetrically via a bearing rod on a second unit head that is mounted for reciprocal motion.

11. The electromotive bed of claim 10, wherein the second gears are mounted on an end of the crank that passes through the sealed cowling and the bearing block, and wherein the filling pad, the remainder of the crank, and the cross rod are located within this sealed cowling.

12. The electromotive bed of claim 1, further comprising a leg supporting device located at the leg section of the electromotive bed.

* * * * *